US005542655A

United States Patent [19]

Murakami

[11] Patent Number: 5,542,655

[45] Date of Patent: Aug. 6, 1996

[54] SHEET FINISHER WITH STAPLE MODE SELECT SWITCH

[75] Inventor: Koichi Murakami, Yokohama, Japan

[73] Assignee: Canon Kabushiki Kaisha, Tokyo, Japan

[21] Appl. No.: 415,578

[22] Filed: Apr. 3, 1995

Related U.S. Application Data

[63] Continuation of Ser. No. 111,393, Aug. 25, 1993, which is a continuation of Ser. No. 760,973, Sep. 17, 1991, abandoned.

[30] Foreign Application Priority Data

Sep. 17, 1990 [JP] Japan ..... 2-246466

[51] Int. Cl.[6] ..... B42C 1/12

[52] U.S. Cl. ..... 270/58.09; 355/324; 270/58.14

[58] Field of Search ..... 270/53, 58; 355/324

[56] References Cited

U.S. PATENT DOCUMENTS

| | | | |
|---|---|---|---|
| 4,370,052 | 1/1983 | Murakami et al. . | |
| 4,603,971 | 8/1986 | Kukucka et al. | 270/53 X |
| 4,811,048 | 3/1989 | Ishikawa et al. | 355/324 X |
| 4,917,366 | 4/1990 | Murakami et al. . | |
| 4,928,941 | 5/1990 | Uto | 270/53 |
| 4,946,153 | 8/1990 | Kinoshita | 270/53 |
| 4,965,629 | 10/1990 | Hiroi et al. | 355/324 X |
| 4,973,036 | 11/1990 | Yamashita | 270/53 |
| 4,986,520 | 1/1991 | Shido et al. | 270/53 |
| 5,032,876 | 7/1991 | Murakami et al. . | |
| 5,092,509 | 3/1992 | Naito et al. | 270/53 X |
| 5,139,249 | 8/1992 | Hosoi et al. | 270/53 |
| 5,382,016 | 1/1995 | Kobayashi et al. | 270/53 X |

FOREIGN PATENT DOCUMENTS

| | | | |
|---|---|---|---|
| 346851 | 12/1989 | European Pat. Off. | 270/53 |

*Primary Examiner*—John E. Ryznic

*Attorney, Agent, or Firm*—Fitzpatrick, Cella, Harper & Scinto

[57] ABSTRACT

A sheet post-processing apparatus, capable of being coupled with a sheet discharging portion of an image forming apparatus includes a tray for stacking sheets discharged from the image forming apparatus; stapler for stapling the stacked sheets; stapling mode selector; a controller for operating the stapler when sheet discharge of the image forming apparatus is completed, and a stapling mode is selected by the stapling mode selector. The stapling apparatus contains a manually operable stapling mode selecting switch to place the stapler in a ready state, waiting for a copy completion signal before the stapling opperation begins.

24 Claims, 14 Drawing Sheets

SHEET FINISHER WITH STAPLE MODE SELECT SWITCH

This application is a continuation of application Ser. No. 08/111,393, filed Aug. 25, 1993, which is a continuation of application Ser. No. 07/760,973, filed Sep. 17, 1991, now abandoned.

FIELD OF THE INVENTION AND RELATED ART

The present invention relates to a sheet post-processing apparatus and an image forming apparatus having the same, more particularly to an image forming apparatus comprising an automatic document feeder and a sorter with a sheet binder, and further particularly to a manually operable sheet binder.

A conventional sorter with a sheet binder has the following three operational modes:

(1) A sorting mode in which the sheets having images are sorted only:

(2) Stapling-sorting mode in which the sheets are automatically bound (or stapled) after they are sorted: and (3) A non-sorting mode in which the sheets are not sorted but are discharged onto the same bin.

Usually, the operational modes are selectable on an operation panel of an image forming apparatus such as a copying machine.

If, however, a sorter having a stapling function is attached to an image forming apparatus which is not provided with means necessary for the second mode operation (the sheets are automatically stapled after they are sorted) using an automatic document feeder, the image forming apparatus is not provided with means for setting a sheet stapling mode on its operation panel. Therefore, it is not possible to start the copying operation after selecting the stapling mode on the image forming apparatus.

SUMMARY OF THE INVENTION

Accordingly, it is a principal object of the present invention to provide a sheet post-processing apparatus and an image forming apparatus having the same in which a sheet post-processing apparatus having a sheet stapling function may be attached to an image forming apparatus not having the stapling mode, so that the stapling operation is possible with such an image forming apparatus.

According to an aspect of the present invention, the sheet post-processing apparatus is provided with switching or control means which is responsive to completion of sheet discharge to start the stapling operation.

According to another aspect of the present invention, upon completion of the sheet discharge, a switching means is actuated to actuate the stapling apparatus in response to a signal indicative of that event, by which the sheet stapling mode operation is possible with an image forming apparatus which is not designed for preparation of the stapling mode.

Even if the operator starts the copying operation without selecting the stapling mode, the operator may select the stapling mode before completion of the image forming operation to effect the automatic stapling.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 1:
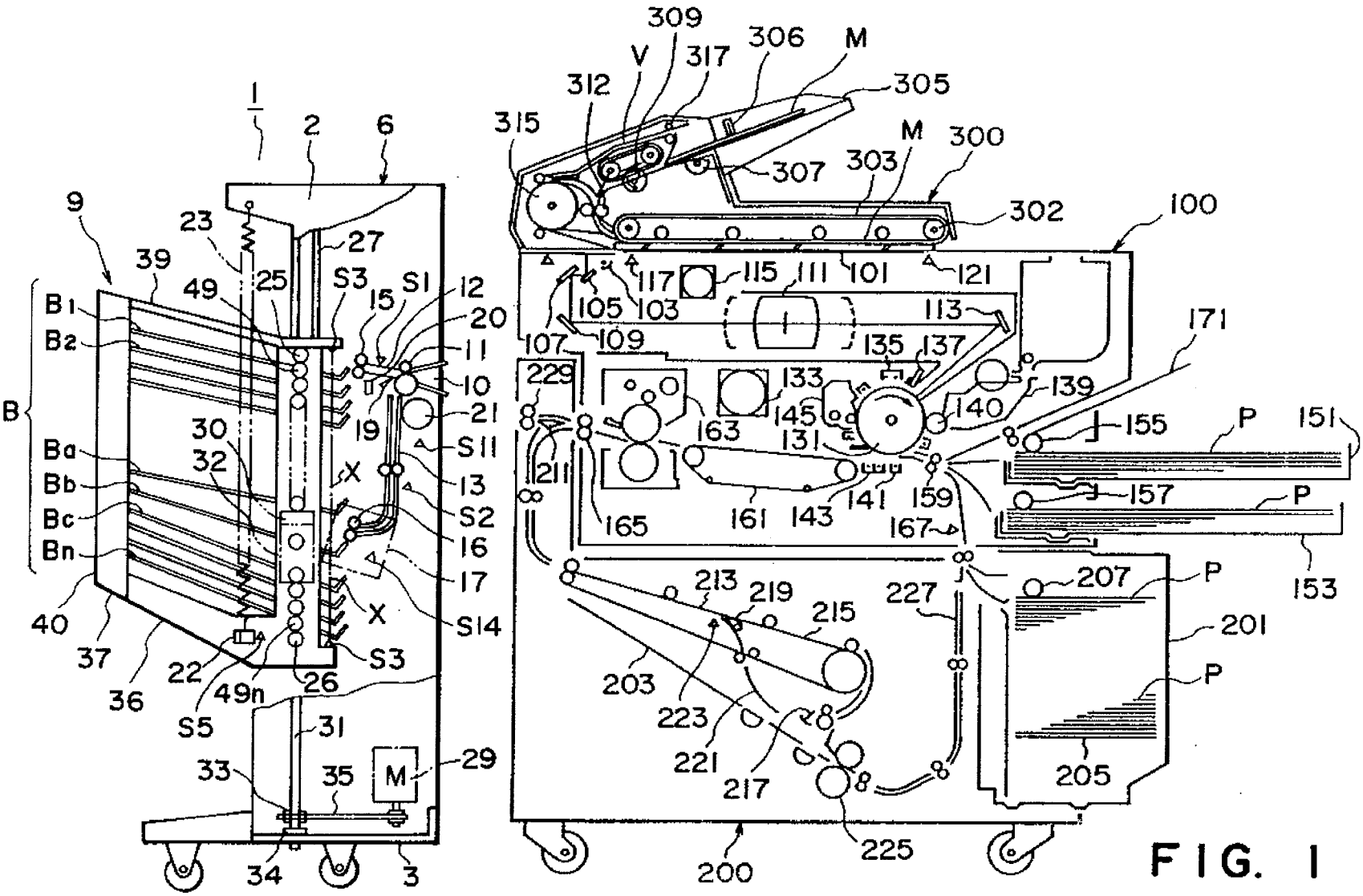
FIG. 1 is a longitudinal sectional view illustrating a general arrangement of a copying apparatus using the present invention.

Referring to FIG. 1, there is shown a general arrangement of the apparatus according to an embodiment of the present invention. The system shown in FIG. 1 comprises a sorter 1 and a copying machine 100.

The description will first be made as to the copying machine 100. The copying machine 100 comprises a platen 101 for placing an original document, an illumination lamp (exposure lamp) 103 for illuminating the original, scanning mirrors 105, 107 and 109 for deflecting optical paths for the original, a zoom and imaging lens 111, a fourth reflection mirror 113 for deflecting the optical path, an optical system motor 115 for driving the optical system, and sensors 117 and 121.

The copying machine 100 further comprises a photosensitive drum 131, a main motor 133 for driving the photosensitive drum 131, a high voltage unit 135, a blank exposure unit 137, a developing device 139, a transfer charger 141, a separation charger 143, and a cleaning device 145.

It further comprises an upper cassette 151, a lower cassette 153, a manual sheet feeding port 171, sheet feeding rollers 155 and 157, registration rollers 159, a conveying belt 161 for conveying a sheet P having a recorded image to an image fixing device, an image fixing device 163 for fixing the image on the sheet by heat and pressure, a roller 165 for discharging the fixed sheet P to a pedestal 200 which will be described in detail hereinafter, and a sensor 167 for detecting sheet during duplex (both sided) recording.

The surface of the photosensitive drum 131 has a seamless photosensitive member comprising a photoconductive layer and a conductive layer. The drum 131 is rotatably supported, and the rotation thereof is started in the direction indicated by an arrow by a main motor 133 responsive to actuation of a copy start key. After the drum 131 is rotated through a predetermined turns, and the potential control (pre-process) is completed, an original M on the platen 101 is illuminated by the illumination lamp 103 integral with the first scanning mirror 105. The light reflected by the original M is imaged on the drum 131 by way of the first scanning mirror 105, the second scanning mirror 107, the third scanning mirror 109, the lens 111 and the reflection mirror 113.

The drum 131 is corona-charged by a high voltage unit 135 and is exposed to original image light through a slit, and an electrostatic latent image is formed on the drum 131 through a known Carlson process process.

Then, the electrostatic latent image on the photosensitive drum 131 is developed by the developing device 139 and is visualized as a toner image, and the toner image is transferred onto the sheet P by the transfer charger 141.

The sheet P supplied from the upper cassette 151, the lower cassette 153 or the manual sheet feeding port 171, is introduced into the main apparatus by the sheet feeding roller 155 or 157. It is further fed to the photosensitive drum 131 at a timed relation with the drum by the registration roller 159, so that the leading edge of the latent image is aligned with the leading edge of the transfer sheet. Thereafter, when the sheet P passes between the transfer charger 141 and the drum 131, the toner image is transferred from the drum 131 onto the sheet P. After the completion of the image transfer operation, the sheet P is separated from the separation charger 143 from the drum 131, and is introduced into the fixing apparatus 163 on the conveying belt 161. In the fixing device 163, the toner image is fixed by pressure and heat, and the sheet is discharged to the outside of the copying machine 100 by the discharging roller 165.

After the image transfer, the drum 131 continues its rotation, and the surface thereof is cleaned by the cleaning device 145 comprising a cleaning roller and an elastic blade.

The pedestal 200 functions to receive the sheets P from the copying machine 100 and retain them for the post-processing. The pedestal 200 is separable from the copying machine 100. It comprises a deck 201 capable of accommodating 2000 sheets P and an intermediate tray 203 which functions during a duplex copy operation. A lifter 205 for the deck 201 rises in accordance with the amount of the sheets P so as to assure contact of the sheet feeding roller 207 to the sheet P.

A sheet discharge flapper 211 functions to switch between a passage for the duplex recording and superposing recording mode and a discharging path. The pedestal 200 further comprises passages 213 and 215 for the conveying belt, a weight 217 in an intermediate tray for confining sheets. The sheet P having passed through the passages 213 and 215 is reversed and accommodated in the intermediate tray 203 for the duplex copy mode. A flapper 219 switches between the duplex mode path and the superposing mode path and is disposed between the passages 213 and 215. It is rotatable upwardly to introduced the sheet P into the superposing passage 221. A sheet sensor 223 detects in the superposing mode a trading end of the sheet P when the flapper 219 is driven. Sheet discharging rollers 225 function to re-feed the sheet P to the drum 131 through the passage 227, and sheet discharging rollers 229 discharge the sheet P to the outside of the apparatus.

In the duplex mode (duplex copy) and the superposing recording (superposing copy), the sheet discharge flapper 211 of the copying machine 100 is rotated upwardly to accommodate the recorded or copied sheet P into the intermediate tray 203 through the passages 2113 and 215 of the pedestal 200. At this time, in the case of the duplex mode, the flapper 219 is lowered, and in the superposing mode, the flapper 219 is lifted. The sheet is introduced onto the intermediate tray 203 through the passage 221. The intermediate tray 203 has a capacity of 99 sheets, for example. The sheets P accommodated on the intermediate tray 203 are confined by the intermediate tray weight 217. For the second copy or recording in the duplex mode or in the superposing mode, the sheet P stored in the intermediate tray 203 is introduced to the registration rollers 159 of the copying machine 100 through the passage 227 with the aid of the re-feeding roller 225 and the weight 217 one-by-one from the bottom.

Designated by a reference numeral 300 is a circulation type document feeder for supplying the originals or documents in the circulating manner (RDF). The document feeder 300 comprises a stacking tray 305 for stacking originals M. In the stacking tray 305, an unshown separating motor is driven in the case of simplex originals. Then, the originals M are fed out one-by-one from the bottom by means of a crescent roller 307, a separating and conveying roller 309 and a separating belt 310. The belt motor 302 driven feeds the original to the exposure position on the platen 101 by the registration roller 312 and a whole surface belt 303, and the original is stopped there. Then, the copying operation is started. After the completion of the copying operation, the motor 302 is again energized, so that the original is introduced into a passage V by a large conveying roller. Then, the sheet discharging roller 317 returns the original on the top of the stack of the original. A recycling lever 306 detects one circulation of the originals. At the time of the start of the original feed, it is placed on the top of the stack of the originals M. When the trailing end of the final original passes under the recycling lever 306, it falls by its weight, by which one circulation of the originals M is detected.

Figure 2:
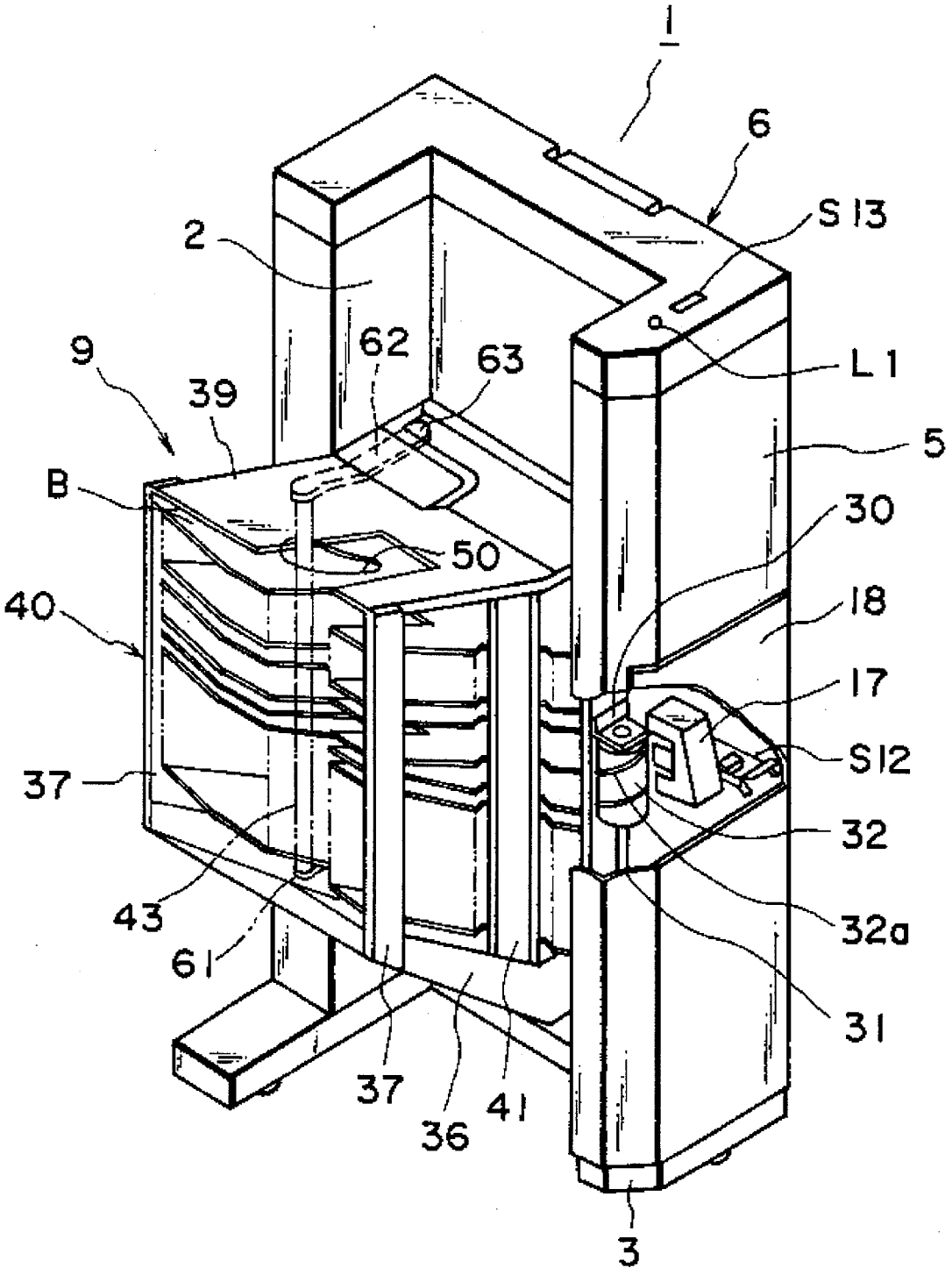
FIG. 2 is a perspective view thereof illustrating a sorter thereof.

Designated by a reference numeral 1 is a sorter for post-processing the sheets. As shown in FIGS. 1 and 2, the sorter 1 comprises a frame 6 including a pair of opposing side plates 2, a base 3 and a cover 5, and a number of bins B (B1–Bn). It also comprises a bin unit 9 which is vertically movable.

The frame 6 is provided with a pair of inlet rollers 11 adjacent an inlet port 10 for reception of the sheet P from the image forming apparatus such as the copying machine 100. Downstream of the pair of rollers 11, there are a non-sort path 12 and a sort path 13 branching out of the non-sort path 12. The non-sort path 12 extends generally horizontally. Downstream thereof, there is a pair of non-sort discharging rollers constituting a discharging outlet. The sort-path 13 extends downwardly. Downstream thereof, there are a pair of sort discharge rollers constituting a sort discharge outlet. A stapler 17 is disposed in association with the sort discharge roller pair 16.

As shown in FIG. 2, a stapler door 18 and a door switch S12 are provided in a cover 5 at a position facing to the stapler 17. When the staples are to be supplied to the stapler 17, the stapler door 18 is opened, and the door switch S12 detects the opening or closing of the stapler door 18. On the top of the cover 5, a manual stapling switch S13 according to the present invention is disposed. The switch S13 enables the operator to select the stapling mode. For the purpose of easy discrimination of the depression of the switch S13, a display L1 including a lamp, LED or the like is disposed adjacent the switch S13, as shown in FIG. 2.

In the neighborhood of the receiving rollers 11, a flapper for deflecting the sheet conveyance direction and a flapper solenoid 20 for driving the flapper 19 are disposed. When the flapper solenoid 20 is energized, the flapper 19 is deflected to shift the sheet conveyance direction to the non-sort discharge outlet 15. When the flapper solenoid 20 is deenergized, the sheet conveyance direction is selected toward the sort sheet discharge outlet 16. Adjacent the inlet rollers 19, there is a conveying motor 21 which drives the pair of inlet rollers, non-sorted sheet discharging rollers 15 and the sorted sheet discharging rollers 16.

The non-sort path 12 is provided with a non-sort path sensor S1, and the sort path 13 is provided with a sort path sensor S2. The conveying motor 21 is provided with a conveyance clock sensor S11 for detecting the rotation thereof.

Downstream of the sort discharge rollers 16 and the non-sort discharge rollers 15, the bin unit 9 is disposed which is supported by a spring 23 having an end fixed on the frame 6 and the other end engaged with a hook 22 of the bin unit. It is vertically movably supported. Adjacent a base side of the bin unit 9, it is provided with an upper guide roller 25 and a lower guide roller 26 which are rotatably supported. These rollers 25 and 26 are engaged to a guiding plate 27 standing from the frame 6 and rolls on the guiding plate 27 when the bin unit 5 moves vertically, thus, guiding the bin unit 9. A bin unit driving motor 29 is mounted on the frame 6. Adjacent the sort discharging rollers 16, there is a cam shaft holder 30. Between the cam shaft holder 30 and a thrust bearing 34 on the base 3, a lead cam shaft 31 is rotatably supported. Above the lead cam shaft 31, there is a lead cam 32. Below the lead cam shaft 31, a sprocket 33 is fixed. A chain 35 is stretched around the sprocket 33 and the bin unit driving motor 29. The lead cam 32 rotates in the forward and backward directions by the bin unit driving motor 29 which is reversible upon selection.

Figure 3:
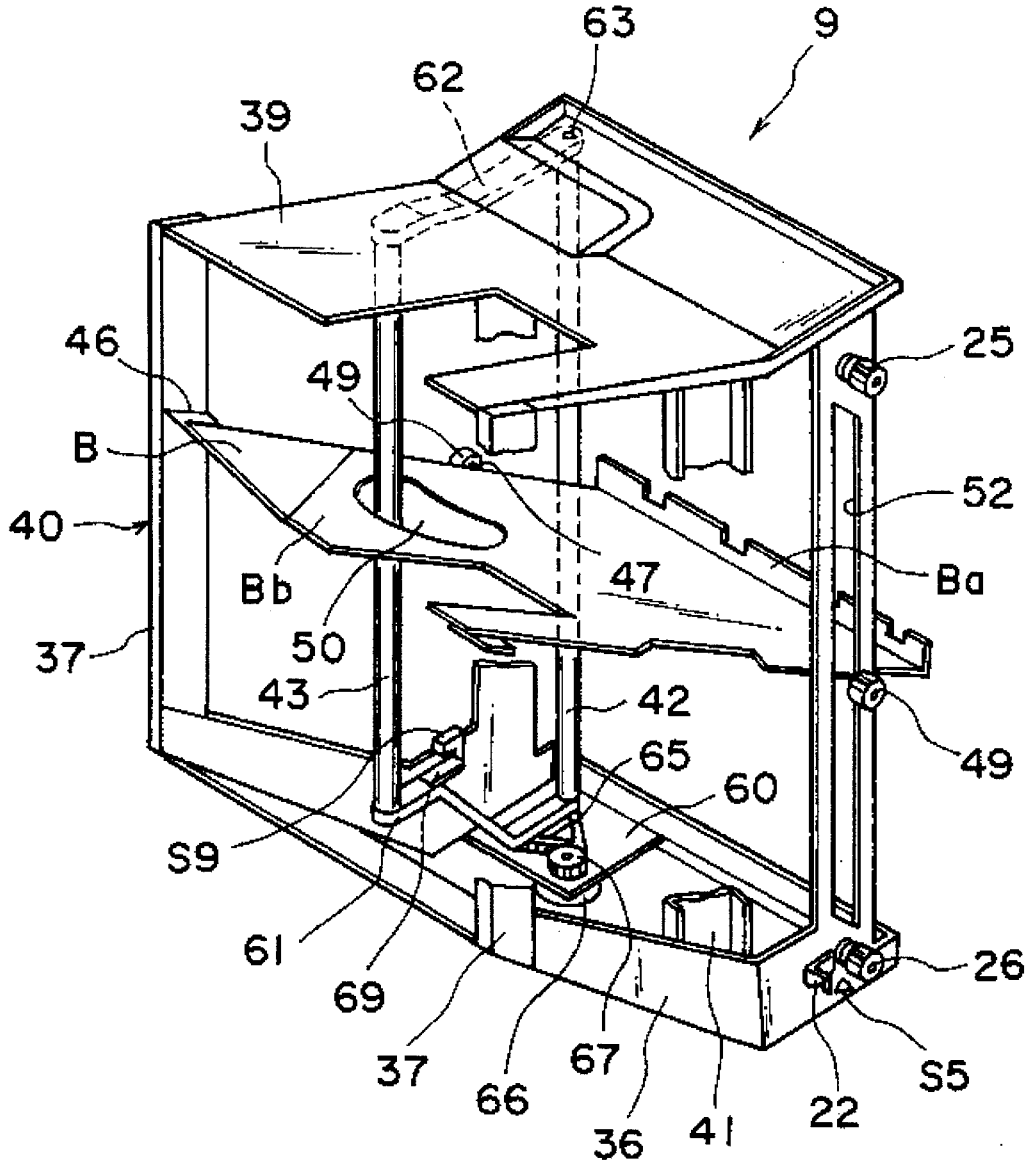
FIG. 3 is a perspective view of a bin unit thereof.

As shown in FIGS. 1–3 in detail, the bin unit 9 comprises a bin unit casing 40 which includes a frame 36 having inclined, vertical and horizontal portions, vertical frames 37 extending vertically at a front and rear sides adjacent an end of the inclined portion of the frame 36, and a bin cover 39 supported on the vertical frames 37. As shown in FIG. 3, at the front side of the bin unit casing 42, there is an alignment reference plate 41 for abutment of an end of the sheet P. The bin unit 9 has a number of bins (B1–Bn) and has an aligning rod 43 swingable about a central shaft 42. As shown in detail in FIG. 4, the bin B is formed into engaging plate-like portions 46 at lateral ends at the leading side. The engaging plate portions 46 are engaged with an unshown supporting plate inside the vertical frame 37, so that the end of the bin B is supported. At each of the lateral ends of the base side of the bin B, a roller supporting pin 47 is fixed on which a bin roller 49 is rotatably supported. The bin B has an elongated slot 50 at a predetermined distance from the central shaft 42, the slot 50 being sufficiently wide as compared with the diameter of the aligning rod 43 and being sufficiently long as compared with the moving distance of the aligning rod 43. The base side Ba of the bin B extends upwardly and vertically to the sheet accommodating surface Bb. As shown in FIGS. 1 and 3, the sheet P on the bin B which is inclined at a predetermined angle with the end upward relative to the frame 6, slides on the sheet accommodating surface Bb until the trailing edge thereof abuts the base side end Ba, so that the sheet is aligned in the vertical direction.

In the bin B, the bin rollers 49 are extended through an elongated slot 52 (FIG. 3) formed adjacent the base side of the bin unit casing 40 and are inserted into the guiding plate 27 of the frame 6. The bin rollers **49*n* of the bottommost bin Bn are placed on the lower guide roller 26, and the bin rollers 49 of the next bin B are placed on the bin rollers 49*n* of the bottommost bin Bn. Similarly, the bin rollers 49 of the upper bin B are supported on the bin rollers 49 immediately below it. In this manner, the base sides of the bins B1–Bn are supported on the bin unit casing 40**.

Figure 5:
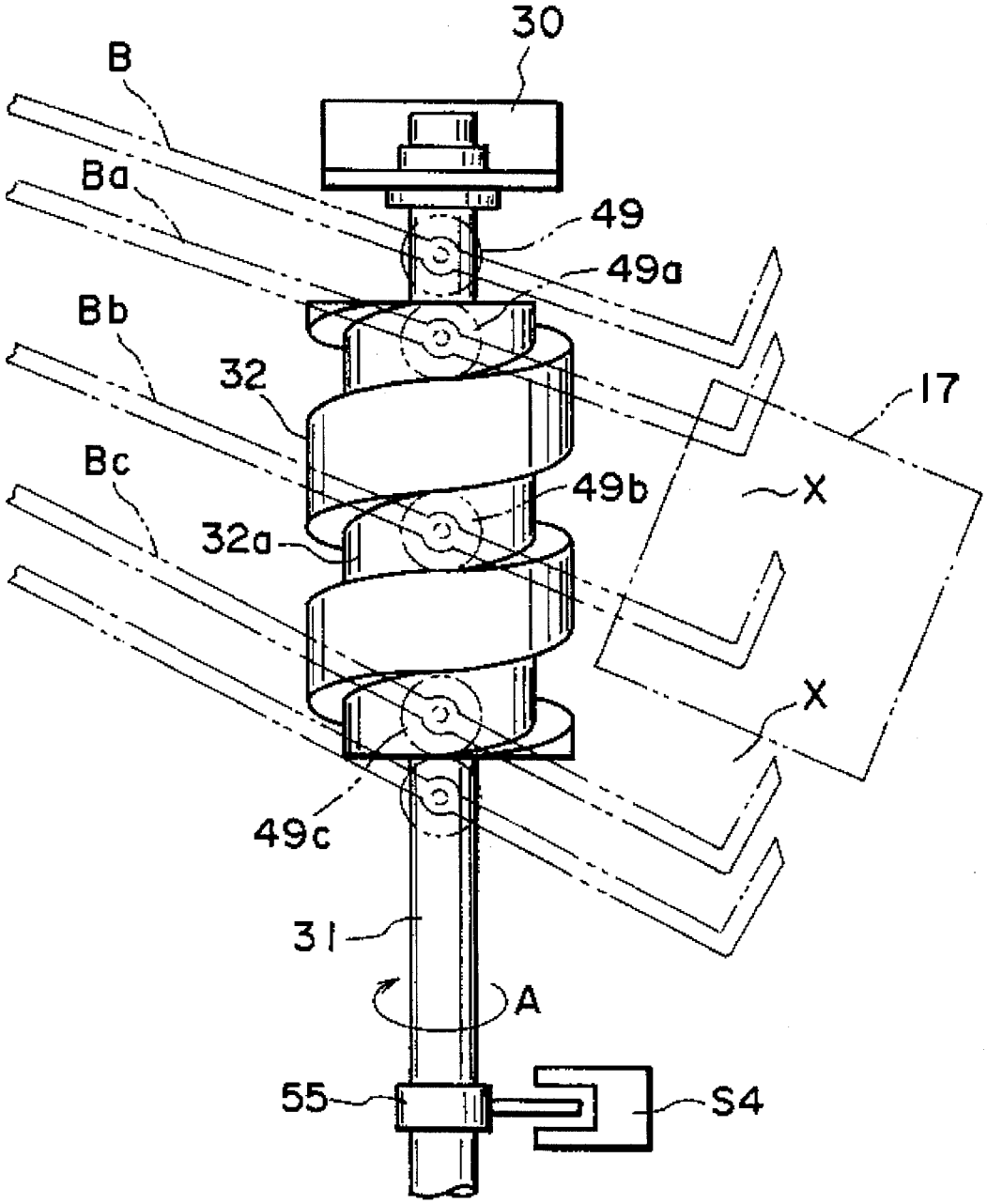
FIG. 5 is a side view of a sorter driver thereof.
Figure 6:
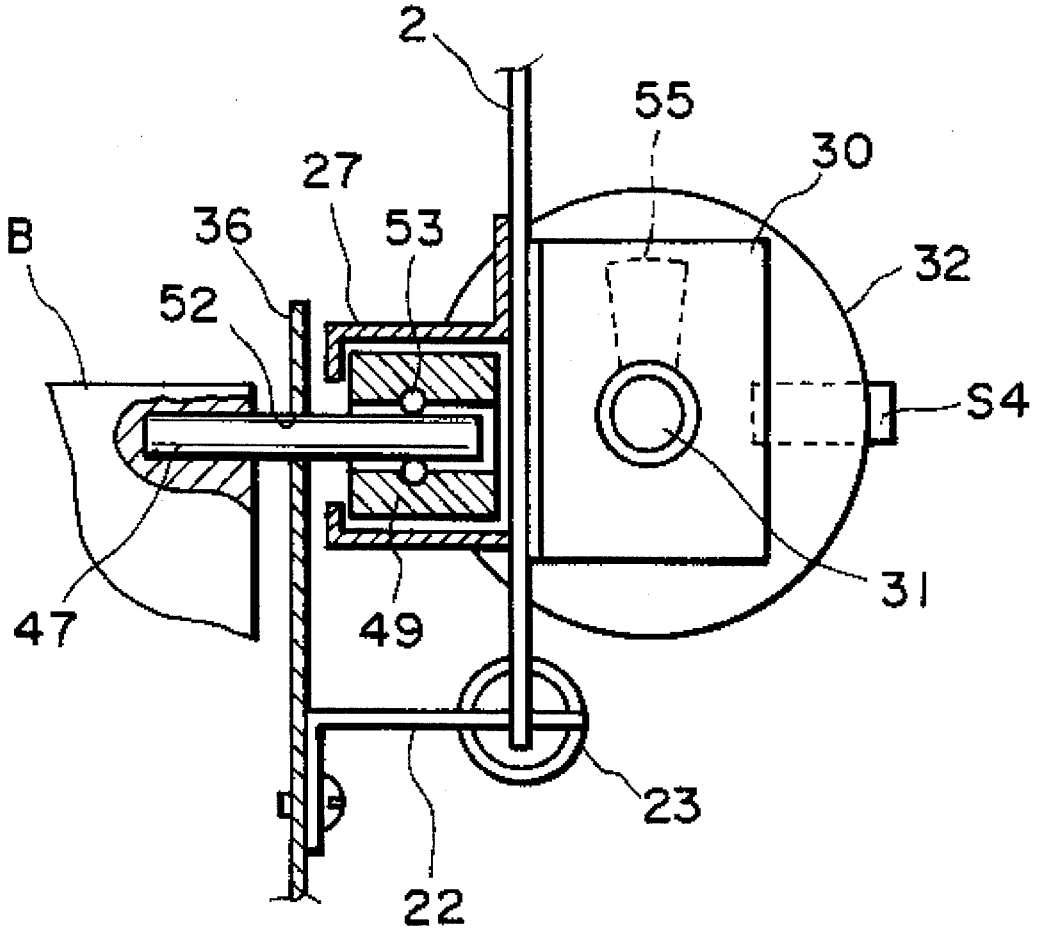
FIG. 6 is a sectional plan view of a bin supporting portion.

As shown in FIGS. 5 and 6, the lead cam 32 is provided with helical cam groove **32*a* having a width slightly larger than the diameter of the bin rollers 49. The lead cam 32 functions to introduce the bin roller 49 present at the position facing to the sort discharging rollers 16, into the cam groove 32*a*. As shown in FIG. 5, by one rotation of the lead cam 32 in the direction indicated by an arrow A, the bin roller 49*c*, of the bin Bc is moved to the intermediate position of the lead cam 32 (the position indicated by a reference 49*b*). By a further one rotation, it is moved to a position disengageable from the cam groove 32*a* of the lead cam (the position indicated by reference 49*a*) when the lead cam 32 rotates further one turn, the bin roller 49*a* at the position 49*a*, raises the upper bin roller 49, and as shown in FIG. 1, the upper bin roller 49 raises a further upper bin roller 49. The topmost bin roller 49 raises the upper guide roller 25, so that the bin unit 9** moves upwardly step-by-step.

In this manner, the bins B1–Bn are sequentially moved upwardly together with the movement of the bin roller 49. As shown in FIGS. 1 and 5, at the position facing to the sort discharging rollers 15, openings X and X which are larger than the space between other adjacent bins, between the bin Ba and the bin Bb and between the bin Bb and the bin Bc to facilitate the reception of the sheet from the sheet discharging rollers 16. In this manner, by the rotation of the lead cam 32, the bin unit 9 moves up or down. As shown in FIGS. 1 and 3, adjacent the hook. 22, a bin home position sensor S5 is disposed. The bin home position sensor S5 detects the bin unit 9 moved to the bottommost home position.

As shown in FIGS. 5 and 6, the lead cam shaft 31 has a flag 55 fixed thereto. At a position facing to the flag 55, a lead cam sensor S4 is disposed. The detection of the lead cam sensor S4 by the flag 55 means one rotation of the lead cam 32, and also the stop position of the lead cam 32 is detected.

Above and below the base side of the bin unit 9, there are transparent type sheet sensors S3 and S3 for sensing the sheet in the bin (FIG. 1). When all of the sheets are taken out of the bin unit 9, the sheet detecting sensors S3 and S3 detect the absence of the sheet, and therefore, the completion of one job is discriminated.

In FIG. 6, reference numeral 53 designates an O-ring pressed into the bin roller 49. It functions to absorb the vibration during the upward and downward movement of the bin B.

As described hereinbefore, the bin unit 9 is provided with the aligning rod 43.

Figure 4:
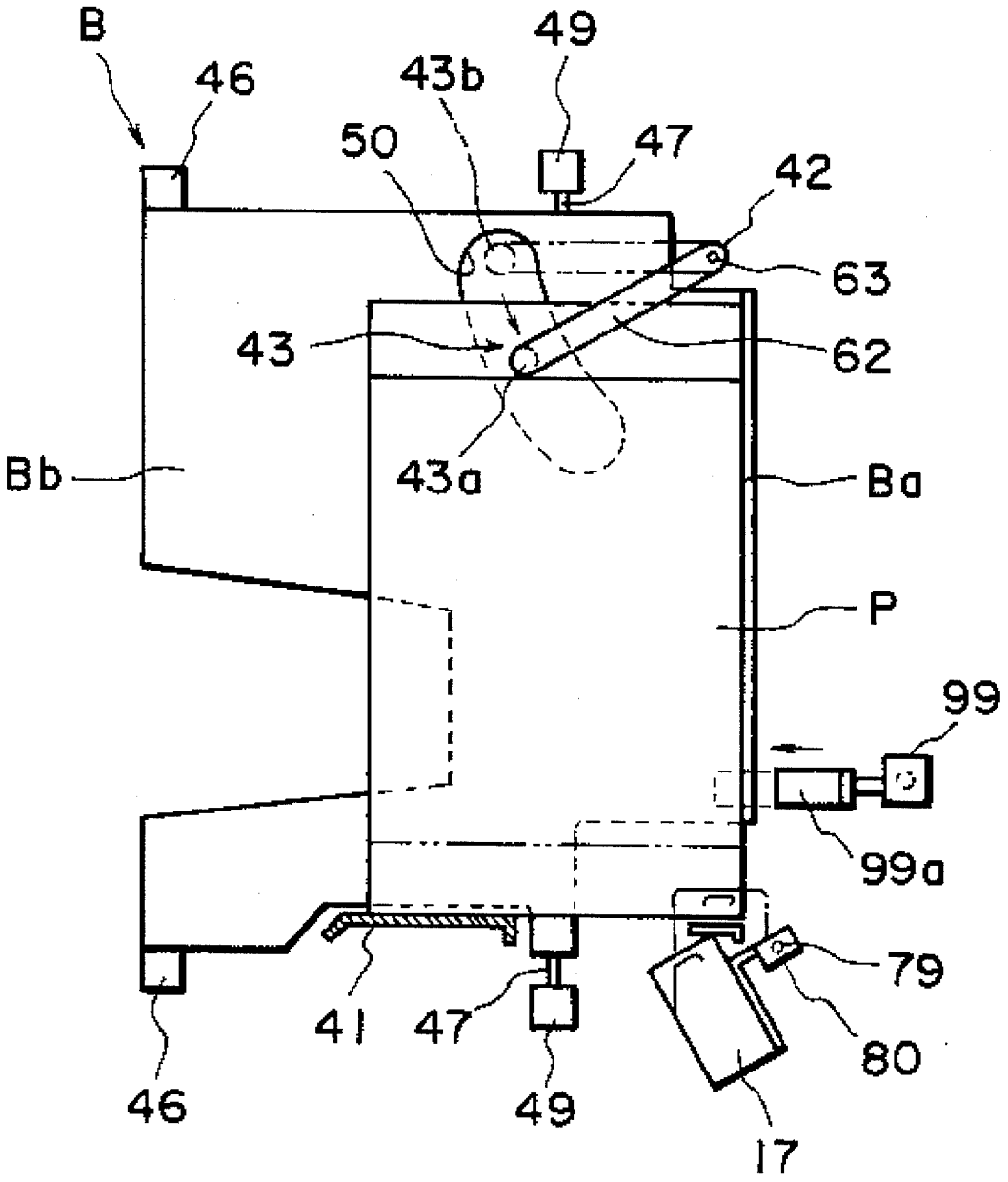
FIG. 4 is a top plan view of the bin unit shown in FIG. 3.

Referring to FIGS. 3 and 4, the sheet alignment using the aligning rod 43 will be described. At a lower position of the base side of the frame 36 of the bin unit 9, there is a supporting plate 60. A lower arm 61 is rotatably supported on the supporting plate 60, and the lower arm 60 is rotatably supported on an unshown lower shaft which is projected upwardly from the supporting plate 60. To an end of the lower arms 61, a bottom portion of a central shaft 42 is fixed coaxially with the lower rotational shaft. To the other, the bottom part of the aligning rod 43 is fixed. Thus, the upper portion of the aligning rod 43 and the upper portion of the central shaft 42 are coupled with an upper arm 62, so that the aligning rod 43, the central shaft 42, the upper arm 62 and the lower arm 61 are integral. The central shaft 42 is rotatably supported on an upper rotational shaft 63 extended downwardly from the bin cover 39, so that the aligning rod 43 is swingable about a central shaft 42. To the lower arm 61, a sector gear 65 having a rotational center aligned with the center of movement of the lower arm 61 is fixed. Below the supporting plate 60, an aligning rod driving motor 66. By the engagement between the output gear 67 of the motor 66 and the sensor gear 65, the aligning rod 43 is swung by the rotation of the motor 66.

The aligning rod 43, for the aligning operation for the sheets P, is moved from the home position (not shown) to a predetermined lateral aligning position 43 determined in accordance with the size of the sheets. By the movement, it abuts the lateral ends of the sheets to align the sheets with the aid of the alignment reference plate 41. Then, it returns to its stand-by position 43 to be prepared for the next aligning operation for the next sheet.

The alignment rod driving motor 66 is a stepping motor in which the distance of the movement of the aligning rod 43 is determined by the number of pulses supplied thereto.

As shown in FIG. 3, to the lower arm 61, a light blocking plate 69 is fixed. The light blocking plate 69 is movable together with the lower arm 61, by which it actuates and deactuates the alignment rod home position sensor S9 fixed on the frame 36.

As described in the foregoing, the stapler 17 is disposed adjacent the sheet discharging rollers 16.

Figure 7:
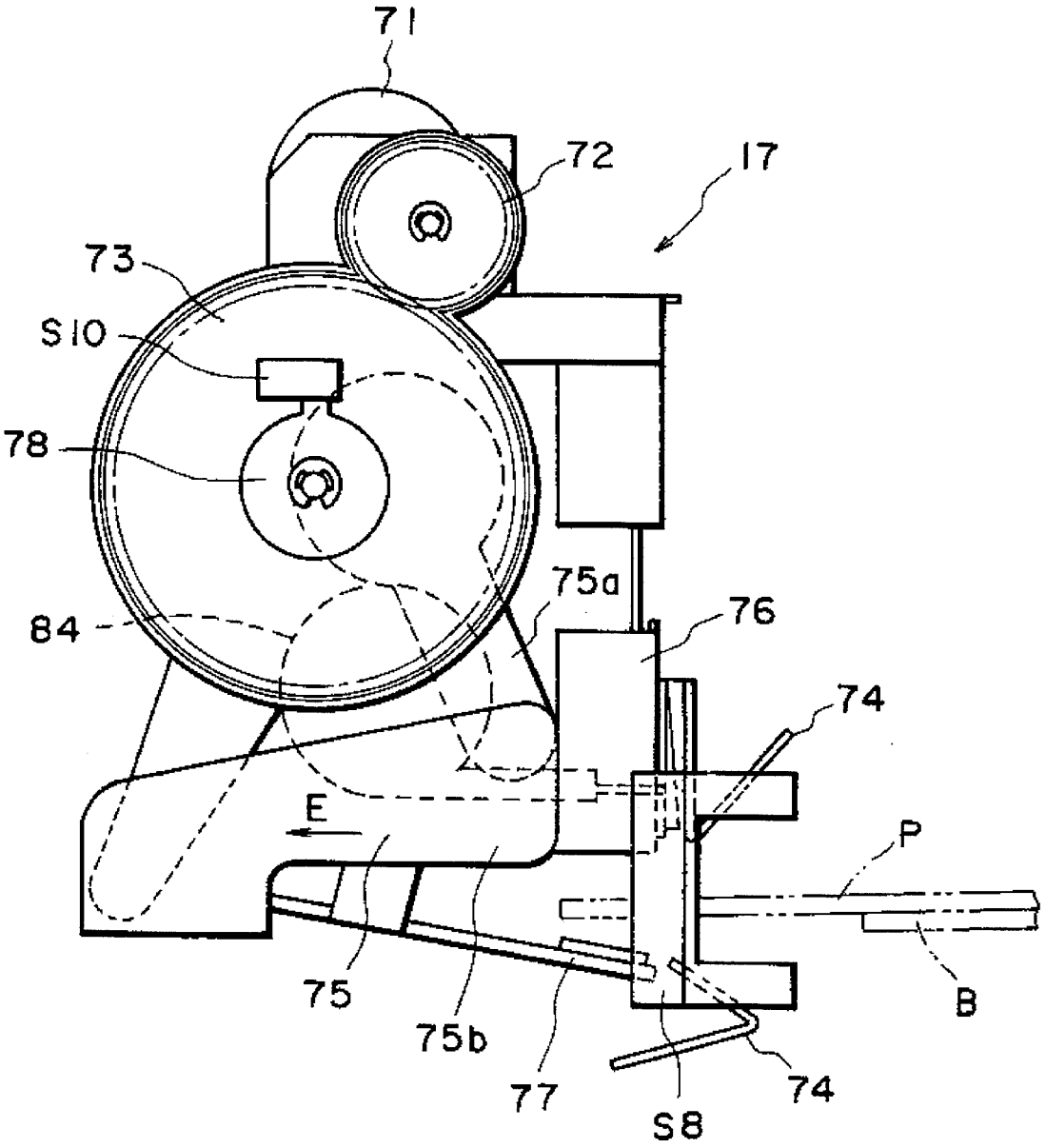
FIG. 7 is a side view of a stapler.
Figure 8:
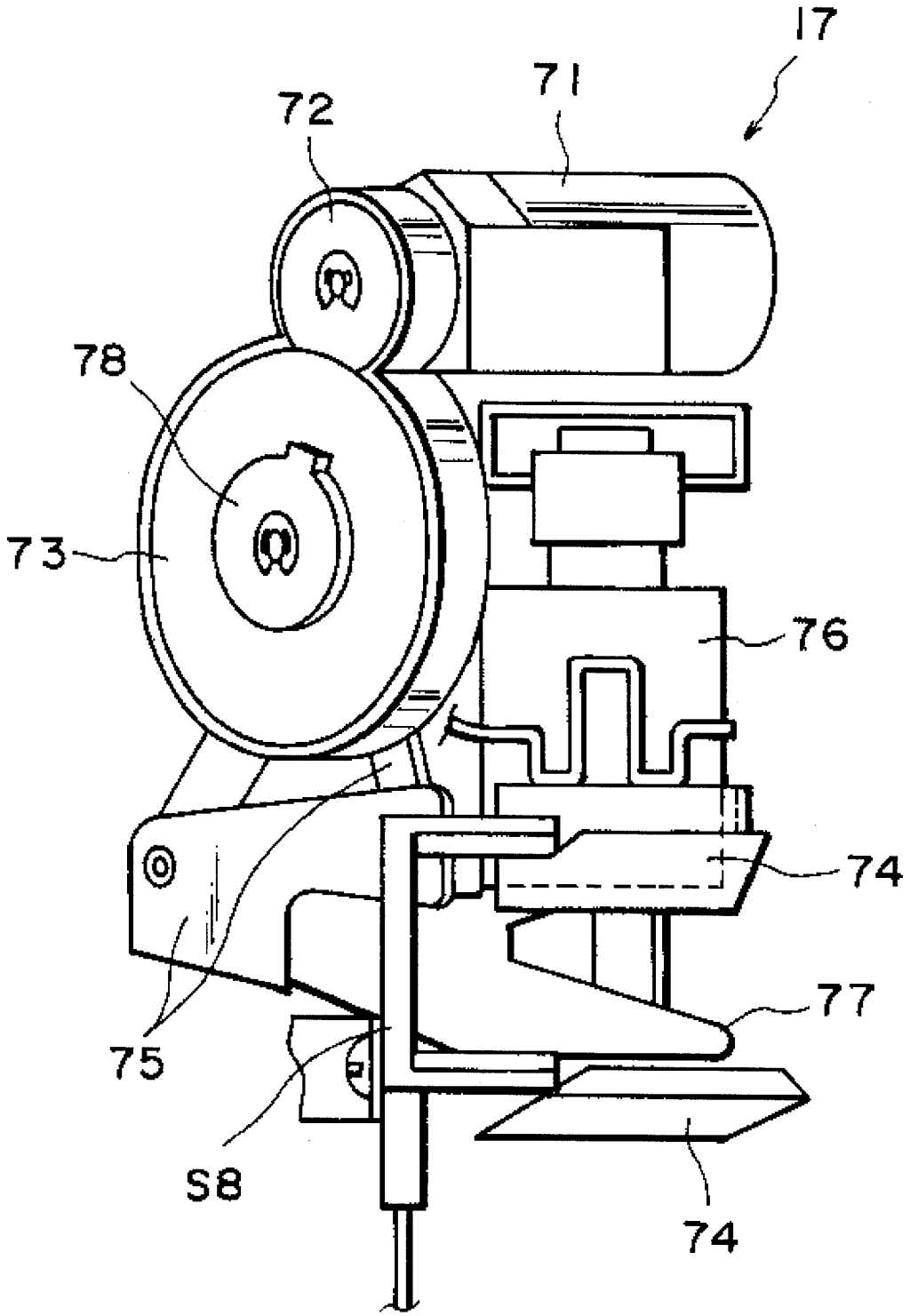
FIG. 8 is a perspective view of the stapler shown in FIG. 7.

The description will be made as to the stapler 17. As shown in FIGS. 7 and 8, the stapler 17 comprises a stapler motor 71 and a driving gear 72 fixed to the output shaft of the stapler motor 71. The driving gear 72 is meshed with a gear 73. A rink 75*a* is supported at its end on an eccentric portion of the gear 73, and a rink 75 is fixed at its one end to the frame. The other ends of the rinks 75*a* and 75 are connected each other. At the articulation 75*b* of the rink 75, a head 76 for stapling action is disposed. Below the head 76, an anvil 77 for bending the staple is disposed. Each of the head 76 and the anvil 77 are guided by the upper and lower guides 74 and 74. Ends of the guides 74 and 74 are opened at one side.

A one rotation cam 78 is coaxially mounted on the gear 73. Faced to the cam 78, there is a stapler cam sensor S10 to detect one stapling operation of the stapler 17.

The stapler 17 has staple cartridge 84 in which a number of connected staples are stored. The staple cartridge 84 is retractable at the backside of the stapler 17, and is retracted in the direction indicated by an arrow E for exchanging the stapler cartridge.

Figure 9:
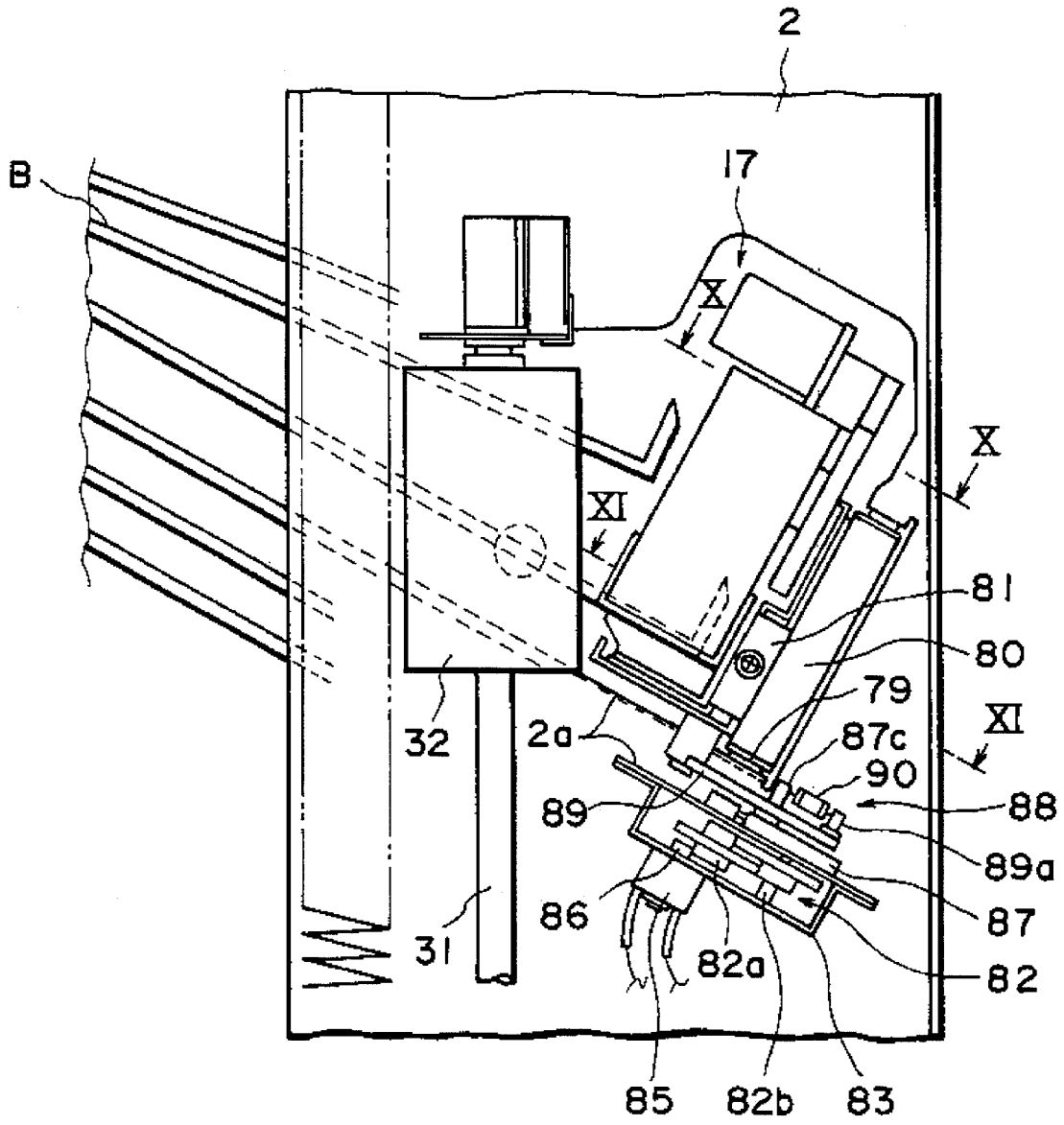
FIG. 9 is a front view of the stapler.
Figure 10:
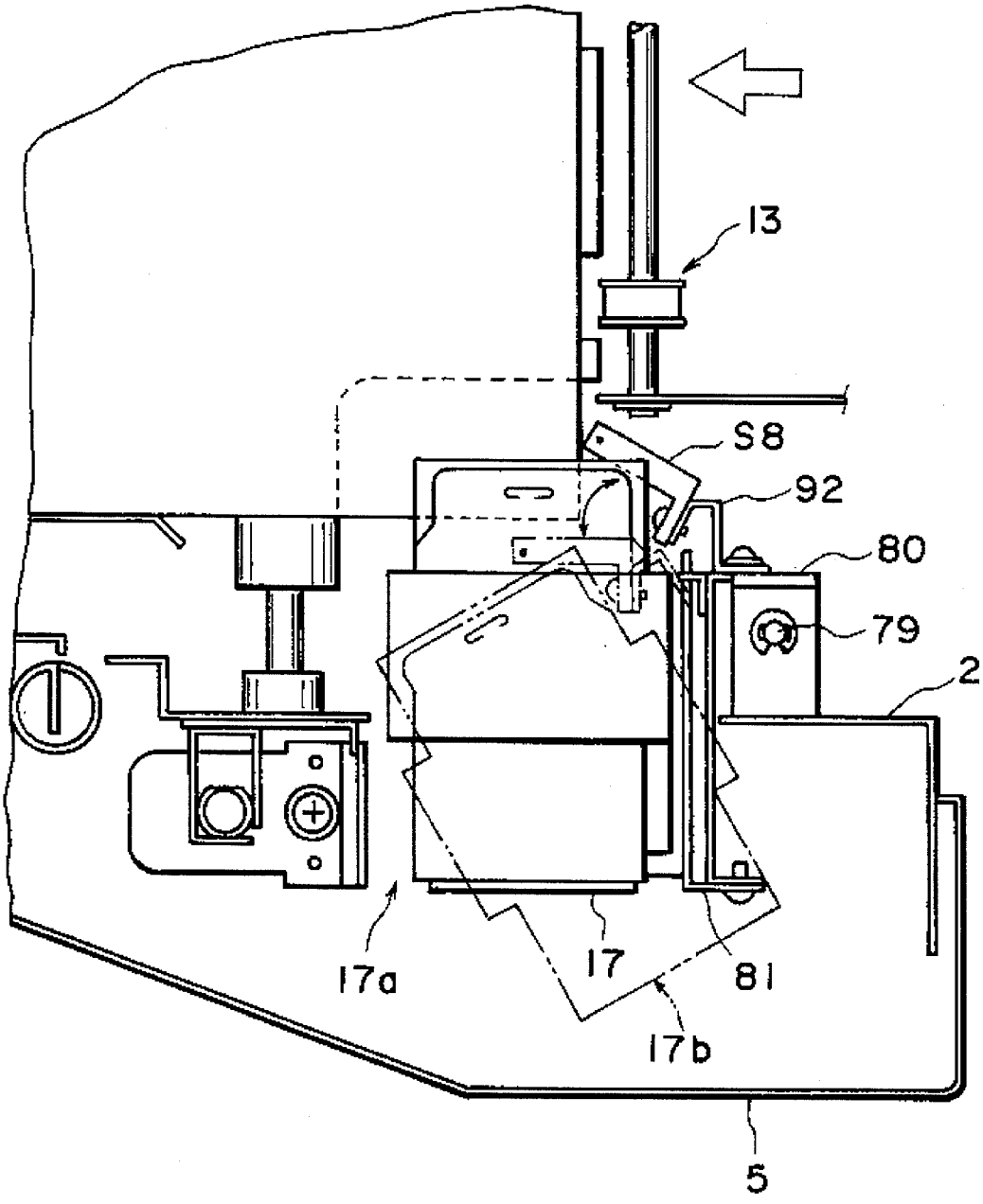
FIG. 10 is a top plan view illustrating operation of the stapler.

The stapler 17 is provided with a stapler moving portion 88 (FIG. 9) for moving its stapling position 17*a* and a retracted position 17*b* as shown in FIG. 10.

Figure 11:
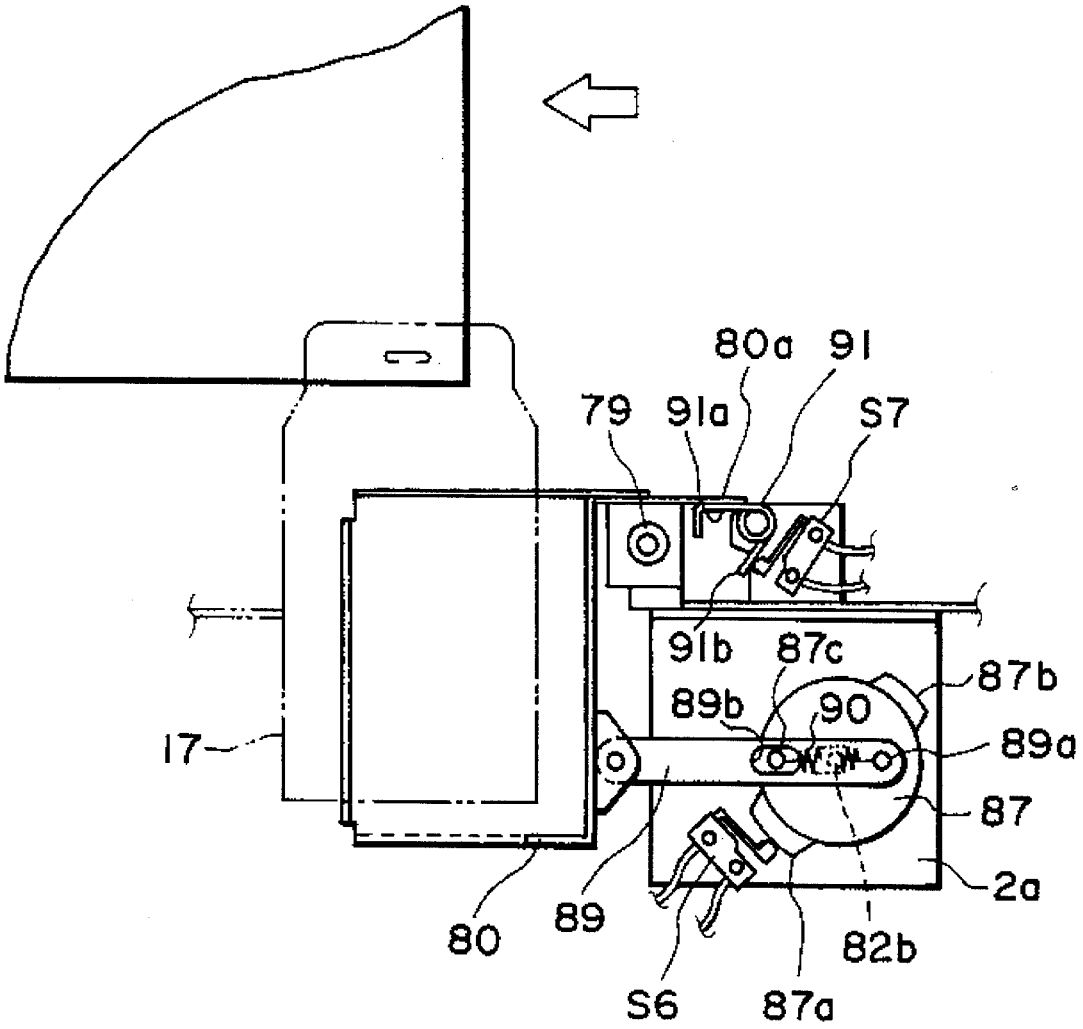
FIG. 11 is a top plan view of a stapler moving means.

As shown in FIGS. 9–11, the stapler mover 88 has a shaft 79 extending from the frame 2*a*, and the swingable base 80 is swingably supported by the shaft 79. A staple base 81 is fixed on the swingable base 80. The stapler 17 is mounted on the stapler base 81. A gear box 83 having a train of reduction gears 82 is mounted to the frame 2*a*. A stapler swinging motor 85 is disposed in the gear box 83. A gear fixed on the output shaft of the stapler swinging motor 85 is in the meshing engagement with the input gear 82*a* of the reduction gear train 82, and a rink disk 87 is fixed to an output gear 82*b* of the reduction gear train 82. Around the rink disk plate 87, as shown in FIG. 11, cam portions 87*a* and 87*b* are opposed to each other. By the cam portions 87*a* and 87*b*, it is moved to the frame 2*a*. Then, the stapler swinging motor 85 is driven, upon which a stapler positioning sensor S6 is actuated or deactuated.

Adjacent the outer periphery of the disk 87, a shaft 87*c* is mounted. To the swingable base 87, a rink arm 89 is rotatably connected in the horizontal state. To the rink arm 89, a shaft 89*a* is mounted, and the rink arm 89 has an elongated slot 89*b*. The shaft 87*c* is engaged with the elongated slot 89*b*, and a spring 90 is stretched between the shaft 87*c* and shaft 89*a*. Adjacent the shaft 79, as shown in FIG. 11, a sensor arm 91 is made of resin material or the like is rotatably supported. An end 91*a* of the sensor operating arm 91 is contacted to an end 80*a* of the swingable base 80, and the other end 91*b* is contacted to a stapler operating position sensor S7.

As shown in FIG. 10, to the swinging base 80, a stapler sheet sensor S8 is disposed by way of a mounting base 92. The sensor S8 as shown in FIG. 8, is constituted by a transparent type sensor in a channel-like shape, having a light emitting and light receiving portions.

When the sheets are to be stapled, the stapler 17 moves by the stapler mover 88 to the stapling position 17*a* interfering the bin moving area. After the stapling operation, it returns to the retracted position 17*b* permitting movement of the bin B, and is retained there. Thereafter, the bin is shifted through the amount corresponding to one bin, and the stapler 17 moves back to the stapling position, and it is retracted to the retracted position 17*b*. The operation is repeated in this manner.

Figure 12A:
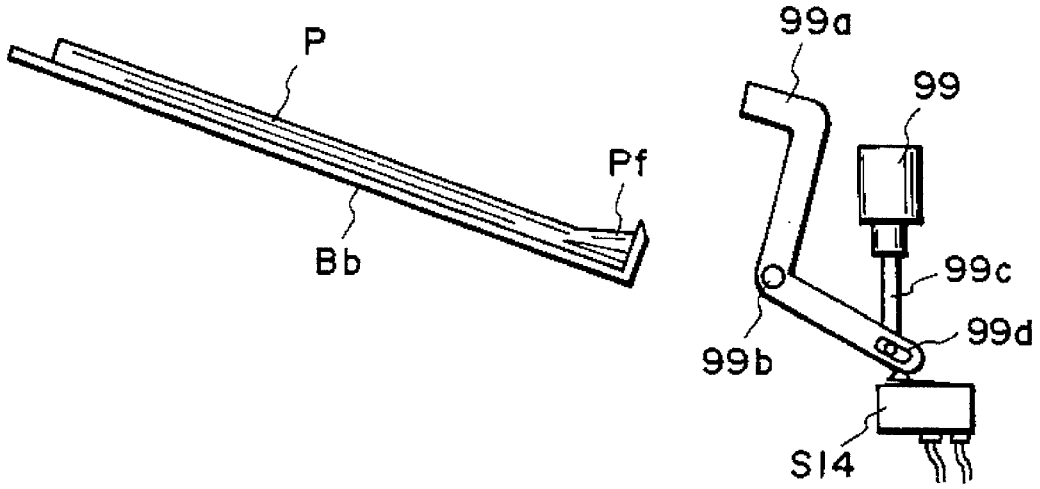
FIG. 12A is a side view wherein a sheet confining means does not confine the sheet.

Referring to FIGS. 4, 12A and 12C, the sheet confining mechanism when the sheet is stapled will be described. The sheet P discharged from the copying apparatus or the like is usually discharged to the sorter 1 after passing through a heat fixing apparatus for the purpose of fixing the toner image. The sheet P is often curled depending on the material of the paper, the quantity of the toner, the distribution of the toner or the heat quantity given by the fixing operation.

If the curl occurs adjacent the stapling position, as shown in FIG. 12A, then when the stapler 17 is moved from the retracted position 17*b* to the stapling position 17*a*, the curled portion Pf of an end of the sheet P abuts the guide 74 of the stapler 17, with the result of misalignment of the sheet so that the sheets are not aligned and stapled.

Figure 12B:
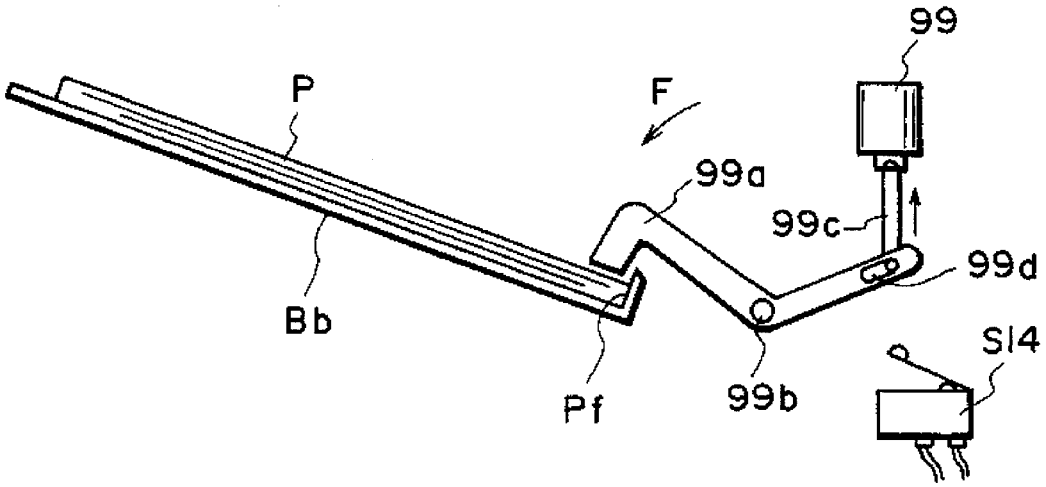
FIG. 12B is a side view wherein the confining means confines the sheet.

In an attempt to solve the problem, a retractable sheet confining mechanism is provided. The sheet confining lever 99*a* is rotatable about a shaft 99*b* fixed. A sheet confining solenoid and a shaft 99*c* are connected with the other end of the shaft 99*c* are inserted into an elongated slot 99*d* of the lever 99*a*. When the solenoid 99 is energized to confine the curled portion Pf of the sheet P, the plunger of the solenoid 99 is raised, and the lever 99*a* rotates about the shaft 99*b* in the direction of an arrow F to confine the curled portion Pf (FIG. 12B). The position of the lever 99*a* in the direction perpendicular to the sheet conveyance direction is, as shown in FIG. 4, adjacent the stapling position for the bin B. The sheet confining position sensor S14 is deactuated at the position confining the curl Pf.

Figure 13:
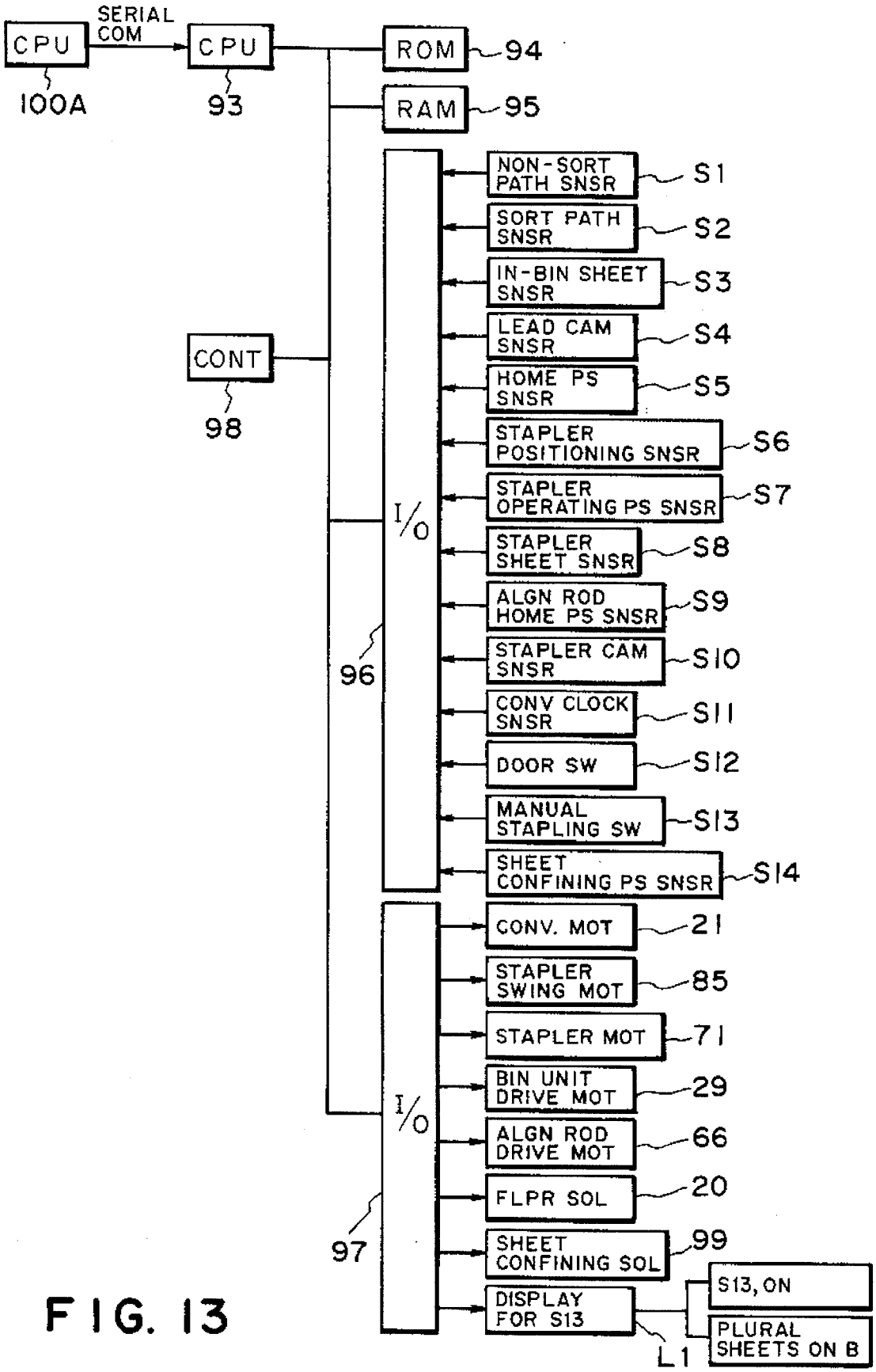
FIG. 13 is a block diagram of a control system.

As shown in FIG. 13, the sorter 1 has a control device 98 including a central processing unit (CPU) 93, read only memory (ROM) 94, random access memory (RAM) 95, input port 96, an output port 97 or the like. The ROM 94 stores a controlling problem, and the RAM 95 stores input data and working data. The input port 96 is connected with sensors S1–S13 and various switches. The output port 97 is connected with a conveying motor 21, various motors and solenoid driving means for the sorter. The CPU 93 controls various parts connected thereto in accordance with the controlling problem stored in the ROM 94. The CPU 93 is provided with a serial interface to carry out serial communication between the copying machine 100 and the central processing unit (CPU) 100A, for example to control various parts in accordance with the signals from the copying machine 100. When the sorter 1 is connected with the copying machine 100, the CPU 93 and the CPU 100A are connected by a connector. The copying operation may be carried out using the document feeder 300. If the manual stapling switch S13 is actuated before the completion of the copying operation (before the completion of the discharge of all of the sheets), the event is supplied to the RAM 95. By the program in the ROM 94, the display L1 for the switch S13 displays "S13-ON" and the sheets P discharged on the sorter 1 are stapled. If the switch S13 is depressed after the completion of the copying operation, they are stapled at that time.

Figure 14:
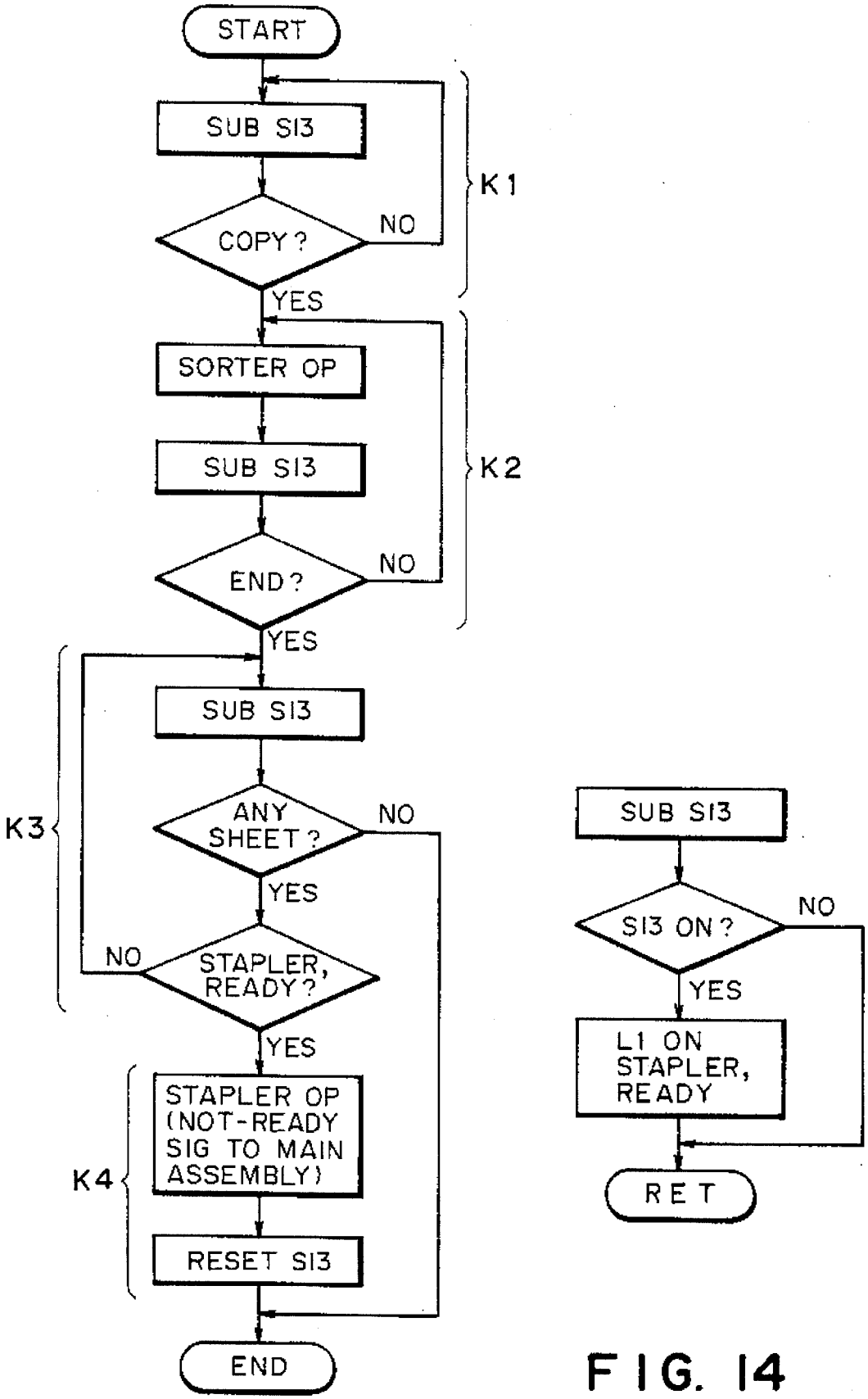
FIG. 14 is a flow chart illustrating the sequential operations.

Referring to FIG. 14, the operation of the apparatus of this embodiment will be described. FIG. 14 deals with the sort mode copy operation.

In the sub-routine SUBS13, when the manual stapling switch S13 is actuated, the display L1 is actuated, and the stapler operating circuit becomes ready state, and the completion of the sheet discharge to the bins B is awaited.

This sub-routine work can be carried out at any point of time before the completion of the sheet discharge to the bin B, and therefore, is included in the steps K1, K2 and K3 of the flow chart. The completion of the sheet discharge is detected by the sensor S2 detecting the last sheet at the discharge outlet after the completion of the original circulation in the document feeder 300.

At step K1, the sub-routine SUBS13 is normally carried out repeatedly during the stand-by period. When the start of the copy operation is detected by the communication with the copying machine 100, a step K2 is executed to start the operation of the sorter 1. Until the completion of the copying operation, the sorter 1 is continued to operate. Upon detection of the completion of the copying operation (for example, circulation end signal for the original by the document feeder 300, for example), a step K3 is carried out, by which the presence or absence of the sheets P in the bin B is detected by a in-bin detection sensor S3. If the operator does not want to staple the sheets, the sheets P are all retracted out of the bins B. Then, the absence of the sheets is detected. This is an end of the operation.

If however, at step K3, there is sheets in the bins B, and the stapler is in the ready state, that is, if the manual stapling switch S13 is actuated beforehand, the stapling operation automatically starts. During the stapling operation, it is not desirable that the copying machine 100 starts the next copying operation because it may cause the jam or the like. Therefore, a signal indicative of not-ready of the sorter 1 is supplied to the copying machine 100. Thus, the copying machine 100 does not start the next copying operation during the stapling operation being carried out.

Upon completion of all of the stapling operations, a signal indicative of the ready state of the sorter 1 is supplied to the copying machine 100, and the manual stapling switch S13 is reset. This is an end of copying operation.

The foregoing deals with the copying operation using the document feeder.

In the case of the copying operation in the book mode, if the event that plural sheets P are stacked on the bin is displayed on the display L1, the manual stapling switch S13 is actuated upon the completion of the copying operation, if the operator wants to staple them, because one sheet in each of the bins are not stapled.

As described in the foregoing, the apparatus of the present invention is provided with switching means capable of setting the stapling mode, and the switch is actuatable during the stand-by period for the copying operation, during the copying operation before the completion of the copying operation. Therefore, the sorting apparatus is easily usable with a copying machine prepared for the stapling mode operation. It enhances the convenience of the operation even in the case of the stapling mode is prepared by the copying machine. Since the actuation of the switch is displayed on the display, the operator is notified of the fact that the stapler is in use. Even in the book mode copying operation, the stapling operation is possible when two or more copy sheets are produced.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus separate from and connectable to a sheet discharging portion of an image forming apparatus without operativity in a binding mode in which discharged sheets are bound, having an automatic document feeder and generating a completion signal indicative of a completion of feeding of a set of originals, said sheet post-processing apparatus comprising:

means for stacking sheets discharged from said image forming apparatus;

binding means for binding a set of sheets stacked on said stacking means;

operation control means for automatically operating said binding means after a last sheet is discharged to said stacking means, when both said completion signal and a binding instruction signal have been generated; and manually operable binding mode selecting means for supplying said binding instruction signal to said operation control means, said binding instruction signal placing said operation control means in a ready state, waiting for generation of said completion signal.

2. An apparatus according to claim 1, wherein said stacking means comprises plural bin trays shiftable step-by-step relative to the sheet discharging portion.

3. An apparatus according to claim 1, wherein said binding mode selecting means is disposed at a position manually and externally operable.

4. An apparatus according to claim 1, further comprising display means for displaying actuation of said binding mode selecting means.

5. An apparatus according to claim 1, wherein said stacking means is in the form of a sorter provided with a plurality of bin trays, and said binding means functions to bind the sheets stacked on the plural bin trays, wherein a sorting mode is set in said sorter by a selecting means of said image forming apparatus.

6. An apparatus according to claim 1, further comprising means for detecting discharge of the last sheet to said stacking means, wherein said operation control means in the ready state operates said binding means in response to an output of said detecting means.

7. An apparatus according to claim 1, further comprising binding control means for controlling said binding means to manually bind when said manually operable binding mode selecting means is depressed after the last sheet is discharged.

8. An image forming apparatus without operativity in a binding mode in which discharged sheets are bound, comprising image forming means for forming an image on a sheet at an image forming position, an automatic document feeder for feeding originals to an image reading position, a sheet discharging portion for discharging recorded-on sheets from said image forming position to a post-processing apparatus and means for generating a completion signal indicative of a completion of feeding of a set of originals, said post-processing apparatus comprising:

means for stacking sheets discharged from said image forming apparatus;

binding means for binding a set of sheets tacked on said stacking means;

operation control means for automatically operating said binding means after a last sheet is discharged to said stacking means when both said completion signal and a binding instruction signal have been generated; and manually operable binding mode selecting means for supplying said binding instruction signal to said operation control means, said binding instruction signal placing said operation control means in a ready state, waiting for generation of said completion signal, wherein said image forming apparatus further comprises signal control means for supplying a signal indicative of a completion of an image forming operation to said operation control means on the basis of the completion signal indicative of completion of feeding of that set of originals.

9. An apparatus according to claim 8, wherein said stacking means is in the form of a sorter provided with a plurality of bin trays, and said binding means binds the sheets stacked on the plural bin trays, wherein a sorting mode is set in said sorter by a selecting means of said image forming apparatus.

10. An apparatus according to claim 8, further comprising binding control means for controlling said binding means to manually bind when said manually operable binding mode selecting means is depressed after the last sheet is discharged.

11. A sheet post-processing apparatus separate from and connectable to a sheet discharging portion of an image forming apparatus without operativity in a binding mode in which discharged sheets are bound having means for generating a completion signal indicative of such an operation related to image formation for a last sheet of a stack, said sheet post-processing apparatus comprising:

means for stacking sheets discharged from said image forming apparatus;

binding means for binding a set of sheets stacked on said stacking means;

operation control means for automatically operating said binding means when both said completion signal and a binding instruction signal have been generated; and manually operable binding mode selecting means for supplying said binding instruction signal to said operation control means, before generation of said completion signal, said binding instruction signal placing said operation control means in a ready state, waiting for generation of said completion signal and for automatically operating said binding means after generation of said completion signal.

12. An apparatus according to claim 11, wherein said stacking means is in the form of a sorter provided with a plurality of bin trays, and said binding means binds the sheets stacked on the plural bin trays, wherein a sorting mode is set in said sorter by a selecting means of said image forming apparatus.

13. An apparatus according to claim 11, further comprising binding control means for controlling said binding means to manually bind when said manually operable binding mode selecting means is depressed after the last sheet is discharged.

14. An image forming apparatus, without operativity in a binding mode in which discharged sheets are bound, comprising image forming means for forming an image on a sheet at an image forming position, a sheet discharging portion for discharging recorded-on sheets from said image forming position to a post-processing apparatus and means for generating a completion signal indicative of such an operation related to image formation for a last sheet of a stack, said post-processing apparatus comprising:

means for stacking sheets discharged from said image forming apparatus;

binding means for binding a set of sheets stacked on said stacking means;

an operation control means for automatically operating said binding means when both said completion signal and a binding instruction signal have been generated; and manually operable binding mode selecting means for supplying said binding instruction signal to said operation control means before generation of said completion signal, said binding instruction signal placing said operation control means in a ready state, waiting for generation of said completion signal and for automatically operating said binding means after generation of said completion signal;

wherein said image forming apparatus further comprises a signal control means for supplying a signal indicative of completion of an image forming operation to said operation control means on the basis of the completion signal.

15. An apparatus according to claim 14, wherein said stacking means is in the form of a sorter provided with a plurality of bin trays, and said binding means binds the sheets stacked on the plural bin trays, wherein a sorting mode is set in said sorter by a selecting means of said image forming apparatus.

16. An apparatus according to claim 14, further comprising binding control means for controlling said binding means to manually bind when said manually operable binding mode selecting means is depressed after the last sheet is discharged.

17. A sheet post-processing apparatus separate from and connectable to a sheet discharging portion of an image forming apparatus without operativity in a binding mode in which discharged sheets are bound, having a sorting mode instructing means and means for generating a completion signal indicative of such an operation related to image formation for the last sheet of a stack, said sheet post-processing apparatus comprising:

means for stacking sheets discharged from said image forming apparatus and having a plurality of bin trays;

binding means for binding a set of sheets stacked on said stacking means;

operation control means for automatically operating said binding means when both said completion signal and a binding instruction signal have been generated; and manually operable binding mode selecting means for supplying said binding instruction signal to said operation control means, said binding instruction signal placing said operation control means in a ready state, waiting for generation of said completion signal.

18. An apparatus according to claim 17, further comprising binding control means for controlling said binding means to manually bind when said manually operable binding mode selecting means is depressed after the last sheet is discharged.

19. An image forming apparatus, without operativity in a binding mode in which discharged sheets are bound, comprising, image forming means for forming an image on a sheet, a sorting mode instruction means, a sheet discharging portion for discharging recorded on sheets from said image forming position to a post-processing apparatus and means for generating a completion signal indicative of such an operation related to image formation for a last sheet of a stack, said post-processing apparatus comprising:

means for stacking sheets discharged from said image forming apparatus and having a plurality of bin trays;

binding means for binding a set of sheets stacked on said stacking means;

operation control means for automatically operating said binding means when both said completion signal and a binding instruction signal have been generated; and manually operable binding mode selecting means for supplying said binding instruction signal to said operation control means, said binding instruction signal placing said operation said operation control means in a ready state waiting for generation of said completion signal;

wherein said image forming apparatus further comprises signal control means for supplying a signal indicative of completion of image forming operation to said operating means on the basis of the completion signal.

20. An apparatus according to claim 19, further comprising binding control means for controlling said binding means to manually bind when said manually operable binding mode selecting means is depressed after the last sheet is discharged.

21. A sheet post-processing apparatus separate from and connectable to a sheet discharging portion of an image forming apparatus without operativity in a binding mode in which discharged sheets are hound, generating a completion signal indicative of an operation related to image formation for a last sheet of a stack, said sheet post-processing apparatus comprising:

means for stacking sheets discharged from said image forming apparatus;

binding means for binding a set of sheets stacked on said stacking means;

operation control means for automatically operating said binding means, when both said completion signal and a binding instruction signal have been generated; and manually operable binding mode selecting means for supplying said binding instruction signal to said operation control means, said binding instruction signal placing said operation control means in a ready state, waiting for generation of said completion signal.

22. An apparatus according to claim 21, further comprising binding control means for controlling said binding means to manually bind when said manually operable binding mode selecting means is depressed after the last sheet is discharged.

23. An image forming apparatus, without operativity in a binding mode in which discharged sheets are bound, comprising image forming means for forming an image on a recording medium at an image forming position, a sheet discharging portion for discharging recorded on sheets from said image forming position to a post-processing apparatus and means for generating a completion signal indicative of an operation related to image formation for a last sheet of a stack, said post-processing apparatus comprising:

means for stacking sheets discharged from said image forming apparatus;

binding means for binding the sheets stacked on said stacking means;

operation control means for automatically operating said binding means when both said completion signal and a binding instruction signal have been generated; and manually operable binding mode selecting means for supplying said binding instruction signal to said operation control means, said binding instruction signal placing said operation control means in a ready state, waiting for generation of said completion signal, wherein said image forming apparatus further comprises signal control means for supplying a signal indicative of completion of image forming operation to said operation control means on the basis of the completion signal.

24. An apparatus according to claim 23, further comprising binding control means for controlling said binding means to manually bind when said manually operable binding mode selecting means is depressed after the last sheet is discharged.

* * * * *

UNITED STATES PATENT AND TRADEMARK OFFICE

CERTIFICATE OF CORRECTION

PATENT NO. : 5,542,655 Page 1 of 3

DATED : August 6, 1996

INVENTOR(S) : Koichi MURAKAMI

It is certified that error appears in the above-indentified patent and that said Letters Patent is hereby corrected as shown below:

ON THE TITLE PAGE - ITEM [57] - ABSTRACT:

Line 14, "opperation" should read --operation--.

COLUMN 1:

Line 22 and 24 ":" should read --;--.

COLUMN 3:

Line 7, "turns," should read --turn--;
Line 17, "process" (first occurrence) should be deleted;
Line 33, "from" should read --and--; and
Line 61, "introduced" should read --introduce--.

COLUMN 4:

Line 5, "2113" should read --213--;
Line 27, "driven feeds the original" should read --drive feeds the original--; and
Line 34, "original" (second occurrence) should read --originals--.

COLUMN 5:

Line 42, "and rear sides" should read --and a rear side--.

UNITED STATES PATENT AND TRADEMARK OFFICE

CERTIFICATE OF CORRECTION

PATENT NO. : 5,542,655

DATED : August 6, 1996

INVENTOR(S) : Koichi MURAKAMI

It is certified that error appears in the above-indentified patent and that said Letters Patent is hereby corrected as shown below:

COLUMN 7:

Line 11, "60," should read --60, is--;
Line 41, "connected" should read --connected to--; and,
Line 50, "has" should read --has a--.

COLUMN 8:

Line 15, "is" should be deleted;
Line 23, "a" (last occurrence) should be deleted;
Line 26, "interfering" should read --in--; and
Line 52, "are" should be deleted.

COLUMN 9:

Line 47, "a" should read --an--;
Line 51, "is" should read --are--;
Line 56, "the" (first occurrence) should read --a--; and,
Line 65, "of" should read --of the--.

COLUMN 10:

Line 6, "are" should read --is--; and,
Line 15, "is" should read --being--.

UNITED STATES PATENT AND TRADEMARK OFFICE

CERTIFICATE OF CORRECTION

PATENT NO. : 5,542,655 Page 3 of 3

DATED : August 6, 1996

INVENTOR(S) : Koichi MURAKAMI

It is certified that error appears in the above-indentified patent and that said Letters Patent is hereby corrected as shown below:

COLUMN 11:

Line 17, "tacked" should read --stacked--.

COLUMN 13:

Line 15, "recorded on" should read --recorded-on--;
Line 31, "said operation" (second occurrence) should be deleted;
Line 36, "of" (second occurrence) should read --of the--; and,
Line 46, "hound," should read --bound,--.

COLUMN 14:

Line 21, "recorded on" should read --recorded-on--; and,
Line 42, "of" (second occurrence) should read --of the--.

Signed and Sealed this

Eighteenth Day of February, 1997

Bruce Lehman

*Attest:*

BRUCE LEHMAN

*Attesting Officer*

*Commissioner of Patents and Trademarks*